US011180336B2

(12) United States Patent
Ohashi et al.

(10) Patent No.: US 11,180,336 B2
(45) Date of Patent: Nov. 23, 2021

(54) MEDIUM TRANSPORTING APPARATUS AND POST-PROCESSING APPARATUS

(71) Applicant: SEIKO EPSON CORPORATION, Tokyo (JP)

(72) Inventors: Kazuyoshi Ohashi, Matsumoto (JP); Tsuyoshi Furumido, Shiojiri (JP); Akinobu Nakahata, Shiojiri (JP); Katsuyuki Kondo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 259 days.

(21) Appl. No.: 16/367,049

(22) Filed: Mar. 27, 2019

(65) Prior Publication Data

US 2019/0300319 A1 Oct. 3, 2019

(30) Foreign Application Priority Data

Mar. 30, 2018 (JP) ..... JP2018-069993

(51) Int. Cl.

| | |
|---|---|
| ***B65H 29/24*** | (2006.01) |
| ***B65H 31/24*** | (2006.01) |
| ***B41J 11/00*** | (2006.01) |
| ***B41J 13/00*** | (2006.01) |
| ***B65H 7/08*** | (2006.01) |
| ***B65H 9/00*** | (2006.01) |

(52) U.S. Cl.

CPC ..... *B65H 29/242* (2013.01); *B41J 11/0055* (2013.01); *B41J 13/0045* (2013.01); *B65H 7/08* (2013.01); *B65H 9/002* (2013.01); *B65H 31/24* (2013.01)

(58) Field of Classification Search

CPC . B65H 7/08; B65H 7/20; B65H 9/002; B65H 9/101; B65H 29/24; B65H 29/242; B65H 2301/331; B65H 2406/32; B65H 2406/323; B65H 2511/242; B65H 2701/1311; B65H 2801/24; B65H 2801/27

See application file for complete search history.

(56) References Cited

U.S. PATENT DOCUMENTS

| | | | | |
|---|---|---|---|---|
| 5,564,693 | A * | 10/1996 | Eikis | B65H 5/224 198/689.1 |
| 2008/0111297 | A1* | 5/2008 | Fujita | B65H 9/002 271/227 |
| 2010/0007082 | A1* | 1/2010 | Muller | B65H 5/021 271/228 |

FOREIGN PATENT DOCUMENTS

| | | | |
|---|---|---|---|
| JP | 11-334943 | A | 12/1999 |

* cited by examiner

*Primary Examiner* — Prasad V Gokhale
(74) *Attorney, Agent, or Firm* — Workman Nydegger

(57) ABSTRACT

A medium transporting apparatus includes a transport belt that has a loop shaped, a cling mechanism that causes the medium to cling to the transport belt, a rotation mechanism that transports the medium by rotating the transport belt, a plurality of detection units that detect an transport direction end of the medium, a controller that corrects a skew of the medium, and a stacker on which the medium transported by the transport belt is stacked, in which the plurality of detection units are arranged at positions that are on an upstream side of the transport belt in the first transport direction and that are different from each other in a width direction, and the controller corrects, according to a result of the detection by the detection units, the skew of the medium in a state of being cling to the transport belt.

11 Claims, 12 Drawing Sheets

MEDIUM TRANSPORTING APPARATUS AND POST-PROCESSING APPARATUS

CROSS REFERENCES TO RELATED APPLICATIONS

The entire disclosure of Japanese Patent Application No. 2018-069993, filed Mar. 30, 2018 is expressly incorporated by reference herein.

BACKGROUND

1. Technical Field

The present disclosure relates to a medium transporting apparatus that transports a medium and a post-processing apparatus including the medium transporting apparatus.

2. Related Art

An image forming apparatus disclosed in JP-A-11-334943 is an example of a medium processing apparatus. The image forming apparatus includes a transport belt that transports a paper sheet as an example of a medium in a state in which the paper sheet is sucked by air to be skidable and a side guide that determines a reference position of the transported paper sheet. The image forming apparatus transports a paper sheet toward a side guide in an oblique direction to come into contact with the side guide, forms an image on a paper sheet of which n skew is corrected to follow the side guide, and discharges the paper sheet to a discharge tray as an example of a stacker.

When an image is formed on a paper sheet, resistance to a transport path may change. Therefore, for example, when an image is partially formed on the paper sheet, the paper sheet may move obliquely as the paper sheet is transported. When a paper sheet, which moves greatly obliquely, is transported in an oblique direction to come into contact with the side guide, there is a concern that the paper sheet moves such that an end that is different from an intended end of the paper sheet approaches the side guide, and the skew is not corrected. When the paper sheet, which moves obliquely, is discharged to the discharge tray, alignment of the paper sheet deteriorated.

Such a problem is not limited to an image forming apparatus that forms an image on a paper sheet, and may occur in a medium processing apparatus that records an image on a medium and a post-processing apparatus.

SUMMARY

An advantage of some aspects of the disclosure is to provide a medium processing apparatus and a post-processing apparatus that suppress a reduction in alignment of a medium stacked on a stacker even when a region to be recorded in the medium is biased.

Hereinafter, means of the disclosure and operation effects thereof will be described.

According to an aspect of the disclosure, there is provided a medium transporting apparatus including a transport belt that has a loop shaped, a clinging mechanism that causes a medium to cling to the transport belt, a rotation mechanism that transports the medium by rotating the transport belt, a plurality of detection units that detect a transport direction end of the medium, a correction unit that corrects a skew of the medium, and a stacker on which the medium transported by the transport belt is stacked, in which the plurality of detection units are arranged at positions that are on an upstream side of the transport belt in the transport direction and that are different from each other in a width direction that is perpendicular to the transport direction, and the correction unit corrects, according to a result of the detection by the detection units, the skew of the medium in a state of cling to the transport belt.

With this configuration, since the plurality of detection units are arranged at intervals in the width direction X, the direction and the size in which the medium moves obliquely can be easily detected. The correction unit corrects the skew of the medium in a state of being cling to the transport belt according to a result of the detection by the detection unit. Therefore, even when a region to be recorded in the medium is biased, a reduction in alignment of the medium stacked on the stacker can be suppressed.

In the medium transporting apparatus, further comprising another transport belt arranged in a direction orthogonal to the transporting direction of the medium with respect to the transport belt, the rotation mechanism individually rotate the transport belt and the other transport belt, and the correction unit control the rotation mechanism according to the result of the detection by the detection units.

With this configuration, the pair of transport belts are arranged to be shifted in the width direction, and are individually rotatable by the rotation mechanism. Since the correction unit controls the rotation mechanism according to the result of the detection by the detection unit, the skew can be properly corrected according to the size of the skew of the medium.

In the medium transporting apparatus, it is preferable that the correction unit has a pair of guide units provided at an interval in the width direction, and relatively move the pair of guide units in the width direction according to the result of the detection by the detection units.

With this configuration, the correction unit relatively moves the pair of guide units in the width direction according to the result of the detection by the detection units. Therefore, the width of the guide units can change in accordance with the width and the skew of the medium, and a possibility that the guide units come into contact with the medium more than necessary and thus the medium is damaged can be reduced.

In the medium transporting apparatus, it is preferable that the rotation mechanism transport the medium in a first transport direction by rotating the transport belt in a first rotation direction, and transport the medium in a second transport direction by rotating the transport belt in a second rotation direction that is opposite to the first rotation direction, an interval between the pair of guide units in the width direction on an upstream side in the first transport direction be larger than an interval between the pair of guide units in the width direction on a downstream side in the first transport direction, the pair of guide units be located at a guide position where the guide units guide the medium in the width direction and a retraction position where the guide units are retracted from the medium in the width direction, and the correction unit position the pair of guide units at the guide position when the rotation mechanism rotates the transport belt in the first rotation direction and position the pair of guide units at the retraction position when the rotation mechanism rotates the transport belt in the second rotation direction.

With this configuration, when the medium is transported in the first transport direction, the correction unit positions the pair of guide units in the guide position to correct the skew of the medium. The interval between the pair of guide units in the width direction is larger on an upstream side than on a downstream side in the first transport direction. Therefore, the medium transported in the first transport direction can be easily introduced between the pair of guide units, and the skew of the medium introduced between the pair of guide units can be corrected.

In the medium transporting apparatus, it is preferable that the rotation mechanism transport the medium in a first transport direction by rotating the transport belt in a first rotation direction, and transport the medium in a second transport direction by rotating the transport belt in a second rotation direction that is opposite to the first rotation direction, an interval between the pair of guide units in the width direction on an upstream side in the second transport direction be larger than an interval between the pair of guide units in the width direction on a downstream side in the second transport direction, the pair of guide units be located at a guide position where the guide units guide the medium in the width direction and at a retraction position where the guide units are retracted from the medium in the width direction, and the correction unit position the pair of guide units at the retraction position when the rotation mechanism rotates the transport belt in the first rotation direction, and position the pair of guide units at the guide position when the rotation mechanism rotates the transport belt in the second rotation direction.

With this configuration, when the medium is transported in the second transport direction, the correction unit positions the pair of guide units in the guide position to correct the skew of the medium. The interval between the pair of guide units in the width direction is larger on an upstream side than on a downstream side in the second transport direction. Therefore, the medium transported in the second transport direction can be easily introduced between the pair of guide units, and the skew of the medium introduced between the pair of guide units can be corrected.

In the medium transporting apparatus, it is preferable that the clinging mechanism causes a second surface of the medium, which is on an opposite side of the medium from a stacker-side first surface, to cling to the transport belt.

With this configuration, the clinging mechanism causes, to cling to the transport belt, the second surface that is opposite to the stacker side in the medium. Therefore, the medium cling to the transport belt can be stacked to be dropped from above the stacker, and deviation due to friction between the media can be suppressed.

In the medium transporting apparatus, the clinging mechanism cling the medium to the transport belt by a suction method of sucking air from a hole formed in the transport belt or an electrostatic clinging unit of charging the medium and the transport belt.

With this configuration, the clinging mechanism cling the medium to the transport belt by the suction method and electrostatic clinging unit. Therefore, for example, as compared to a case where the medium is transported by a clinging belt, a possibility that the medium is damaged can be reduced.

According to another aspect of the disclosure, there is provided a post-processing apparatus including a transport belt that has a loop shaped, an clinging mechanism that causes a medium to cling to the transport belt, a rotation mechanism that transports the medium by rotating the transport belt, a plurality of detection units that detect an end of the medium in a transport direction, a correction unit that corrects a skew of the medium, an intermediate stacker on which the medium transported by the transport belt is stacked, a post-processing mechanism that post-processes the medium stacked on the intermediate stacker, and a discharge stacker on which the medium sent out from the intermediate stacker is stacked, in which the plurality of detection units are arranged at positions that are on an upstream side of the transport belt in the transport direction and that are different from each other in a width direction that is perpendicular to the transport direction, and the correction unit corrects a skew of the medium in a state of cling to the transport belt according to a result of the detection by the detection units.

With this configuration, the same effect as the medium transporting apparatus can be obtained.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

First Embodiment

Hereinafter, a medium processing apparatus and a post-processing apparatus according to a first embodiment will be described with reference to the drawings. The medium processing apparatus is an ink jet printer that discharges an ink as an example of a liquid to a medium such as a paper sheet and records a letter or an image on the medium.

Figure 1:
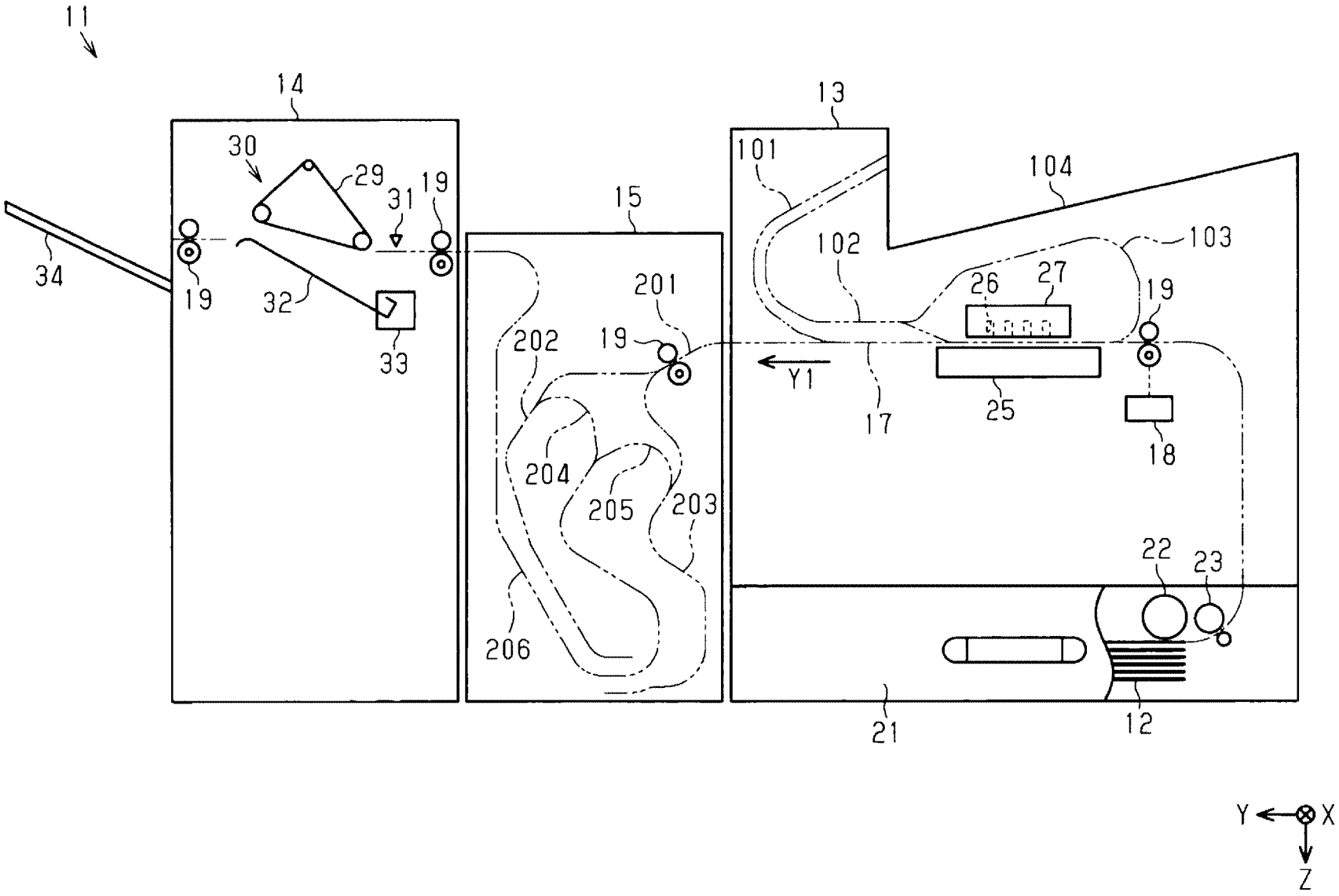
FIG. 1 is a schematic side view illustrating a medium processing apparatus including a post-processing apparatus according to a first embodiment.

As illustrated in FIG. 1, the medium processing apparatus 11 includes a printing device 13 that performs recording on the medium 12, a post-processing apparatus 14 that performs post-processing on the recorded medium 12, and an intermediate device 15 located between the printing device 13 and the post-processing apparatus 14. The post-processing is a process performed accompanying a recording process, and the post-processing apparatus 14 of the present embodiment performs a stapler process of stapling a plurality of recorded media 12.

A transport path 17 continuing from the printing device 13 via the intermediate device 15 to the post-processing apparatus 14 and indicated by a two-dot chain line in FIG. 1 is provided in the medium processing apparatus 11. The medium processing apparatus 11 includes at least one transport roller pair 19 that transports the medium 12 along the transport path 17 by driving the transport motor 18. The transport roller pair 19 may include a transport motor 18 in each of the intermediate device 15 and the post-processing apparatus 14. Further, the printing device 13, the intermediate device 15, and the post-processing apparatus 14 may include a plurality of transport motors 18. Accordingly, operations of the plurality of transport roller pairs 19 in the printing device 13, the intermediate device 15, and the post-processing apparatus 14 can be controlled efficiently.

In the drawing, the medium processing apparatus 11 is placed on a horizontal surface. The direction of gravity is indicated as a Z axis, and directions along a surface intersecting the Z axis are indicated as an X axis and a Y axis. The X axis, the Y axis, and the Z axis be perpendicular to each other, and the X axis and the Y axis are along the horizontal plane. In the following description, an X axis direction is referred to as a width direction X, a Z axis direction is referred to as a vertical direction Z, and a direction perpendicular to the width direction X and along the transport path 17 is referred to as a first transport direction Y1. The first transport direction Y1 is a direction in which the transport roller pair 19 transports the medium 12, and is a direction from the printing device 13 on an upstream side toward a post-processing apparatus 14 on a downstream side.

Cassettes 21 that can accommodate the medium 12 in a stacked state are detachably provided in the printing device 13. The plurality of cassettes 21 may be detachably provided in the printing device 13. The printing device 13 includes a pickup roller 22 that sends the uppermost medium 12 among the medium 12 accommodated in the cassette 21 and a separation roller 23 that separates the medium 12 sent out by the pickup roller 22 one by one.

The printing device 13 includes a support portion 25 that is provided at a position along the transport path 17 and supports the medium 12, and a recording head 27 that performs recording by ejecting a liquid from a nozzle 26 onto the medium 12 supported by the support portion 25. The recording head 27 is provided at a position facing the support portion 25 across the transport path 17. The recording head 27 may be a so-called line head capable of simultaneously ejecting a liquid along the width direction X or may be a so-called serial head that ejects a liquid while moving in the width direction X.

The printing device 13 includes a discharge path 101 as a part of the transport path 17, through which the medium 12 is discharged, a switchback path 102 through which the medium 12 is switch-back-transported, and a reversing path 103 through which a posture of the medium 12 is reversed. The discharge path 101 is a path through which the medium 12 recorded by the recording head 27 is discharged toward a discharge portion 104. The discharge portion 104 is located at an upper portion of the printing device 13. The medium 12 transported along the discharge path 101 is placed on the discharge portion 104.

The switchback path 102 and the reversing path 103 are paths through which the duplex printed medium 12 is transported. The switchback path 102 extends along the discharge path 101. The reversing path 103 extends from the switchback path 102. The reversing path 103 extends from a downstream side of the recording head 27 to an upstream side of the recording head 27 so as to pass above the recording head 27.

When duplex printing is executed, the medium 12, one surface of which is printed, is first transported to the switchback path 102. Next, the medium 12 is switch-back-transported in the switchback path 102. That is, the medium 12 is transported in an opposite direction in the switchback path 102. Next, the medium 12 is transported from the switchback path 102 to the reversing path 103.

As the switchback path 102 or the reversing path 103 is transported, the medium 12 is reversed from a posture in which the printed one surface faces the upper side to a posture in which the printed one surface faces the lower side. The medium 12 transported along the reversing path 103 is recorded again by the recording head 27. At this time, a surface of the medium 12, which is opposite to the already printed surface, is printed. In this manner, the printing device 13 executes duplex printing on the medium 12. The printing device 13 transports the printed medium 12 toward the discharge portion 104 or the intermediate device 15.

The intermediate device 15 includes, as a part of the transport path 17, an introduction path 201, a first switchback path 202, a second switchback path 203, a first junction path 204, a second junction path 205, and a deviation path 206. The introduction path 201 is a path through which the medium 12 is introduced from the printing device 13. The first switchback path 202 and the second switchback path 203 are paths which extend from the introduction path 201 and through which the medium 12 is switch-back-transported. The first switchback path 202 and the second switchback path 203 extend to branch from the introduction path 201.

The first junction path 204 is a path extending from the first switchback path 202. The second junction path 205 is a path extending from the second switchback path 203. The deviation path 206 is a path which extends from the first junction path 204 and the second junction path 205 and from which the medium 12 is derived toward the post-processing apparatus 14. The first junction path 204 and the second junction path 205 are joined to each other at the deviation path 206.

The medium 12 transported from the printing device 13 to the intermediate device 15 is transported along the introduction path 201. The medium 12 transported along the introduction path 201 is transported toward the first switchback path 202 and the second switchback path 203. The medium 12 transported along the introduction path 201 is distributed to the first switchback path 202 and the second switchback path 203 by a flap or the like provided at a location branching from the introduction path 201 to the first switchback path 202 and the second switchback path 203.

The medium 12 transported to the first switchback path 202 is switch-back-transported in the first switchback path 202. When being switch-back-transported in the first switchback path 202, the medium 12 is transported to the first junction path 204. The medium 12 transported along the first junction path 204 is transported to the deviation path 206.

The medium 12 transported from the introduction path 201 to the second switchback path 203 is switch-back-transported in the second switchback path 203. When being switch-back-transported in the second switchback path 203, the medium 12 is transported to the second junction path 205. The medium 12 transported along the second junction path 205 is transported to the deviation path 206.

The medium 12 transported through the intermediate device 15 is switch-back-transported in the first switchback path 202 and the second switchback path 203. Therefore, the medium 12 transported through the intermediate device 15 is reversed from a posture in which a surface printed immediately before faces the upper side to a posture in which the surface printed immediately before faces the lower side, in the printing device 13. Accordingly, the medium 12 deviated by the post-processing apparatus 14 is in a posture in which the surface printed immediately before faces the lower side in the printing device 13. As the medium 12 is transported to the intermediate device 15, a drying time of the medium 12 to which a liquid is ejected is ensured. As the drying time of the medium 12 is ensured, transfer of the liquid discharged to the medium 12, curling of the medium 12 due to moisture of the discharged liquid, and the like can be suppressed.

Next, an embodiment of the post-processing apparatus 14 will be described.

As illustrated in FIG. 1, the post-processing apparatus 14 includes a transport mechanism 30 that transports the medium 12 while the medium 12 is cling onto a transport belt 29 and a detection unit 31 that detects the medium 12 located on an upstream side of the transport mechanism 30 in the first transport direction Y1. The post-processing apparatus 14 includes an intermediate stacker 32 as an example of a stacker for stacking the medium 12 transported by the transport belt 29. The post-processing apparatus 14 includes a post-processing mechanism 33 for post-processing the medium 12 stacked on the intermediate stacker 32 and a discharge stacker 34 on which the medium 12 sent out from the intermediate stacker 32 is stacked.

Figure 2:
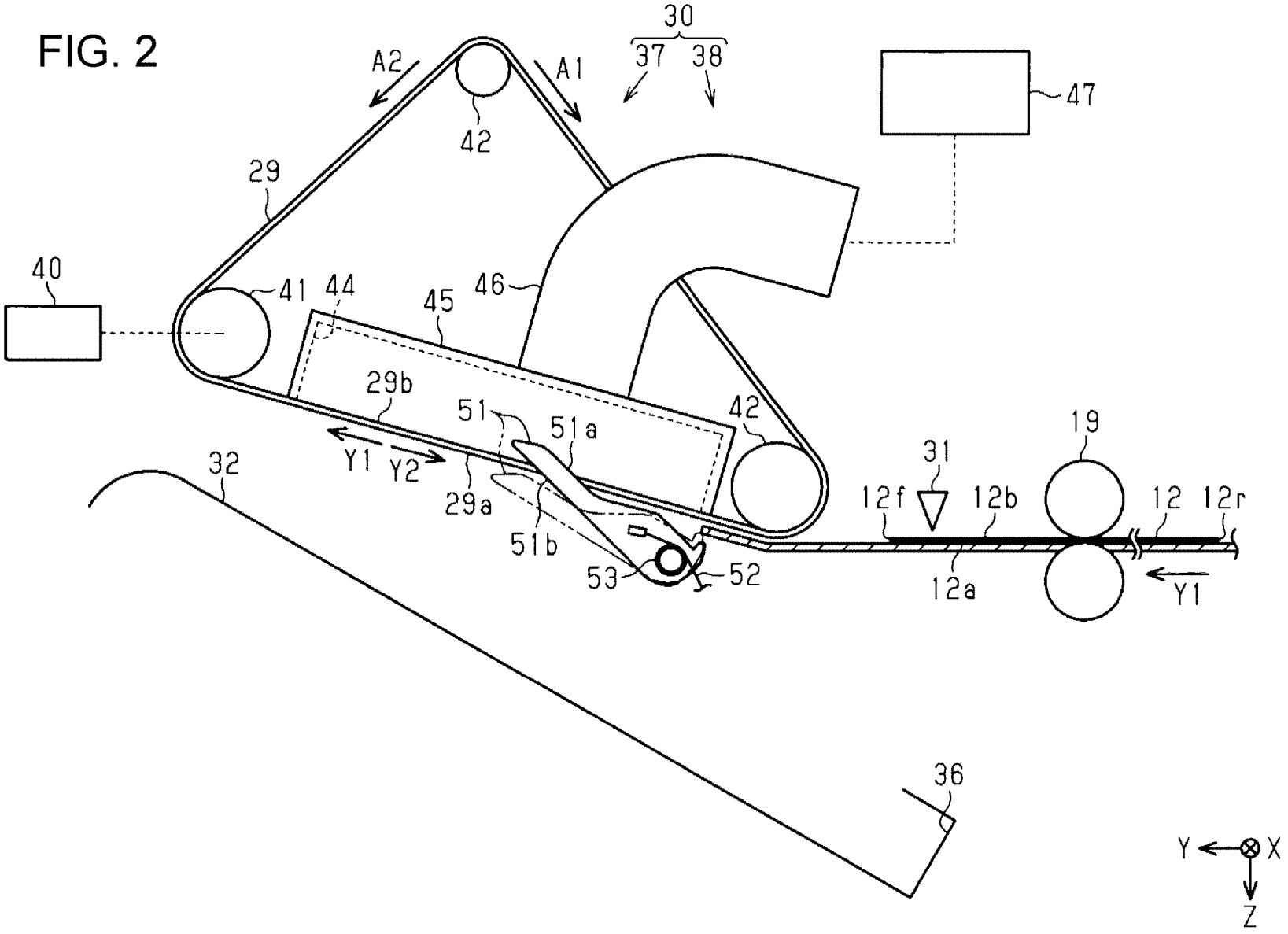
FIG. 2 is a schematic side view of a transport mechanism and an intermediate stacker of the post-processing apparatus.

As illustrated in FIG. 2, the detection unit 31 is, for example, an optical sensor having a light receiving unit and a light emitting unit. The detection unit 31 detects a front end 12*f* which is an end on a downstream side of the medium 12 in the first transport direction Y1 and a rear end 12*r* which is an end on an upstream side of the medium 12 in the first transport direction Y1.

The intermediate stacker 32 includes an alignment unit 36 that aligns the rear end 12*r* of the stacked medium 12. The intermediate stacker 32 is obliquely provided such that an end thereof on the alignment unit 36 side is located on a lower side of an opposite end in a vertical direction Z.

The transport mechanism 30 is provided such that the intermediate stacker 32 and the transport belt 29 face each other on an upper side of the intermediate stacker 32 in the vertical direction Z. The transport mechanism 30 includes a rotation mechanism 37 that transports the medium 12 by rotating the transport belt 29 and a clinging mechanism 38 that causes the medium 12 recorded by the recording head 27 to cling to the loop transport belt 29.

The rotation mechanism 37 includes a belt motor 40 that rotates the transport belt 29, a driving pulley 41 that rotates by driving of the belt motor 40, and a driven pulley 42 that is rotatable about an axial line that is parallel to an axial line of the driving pulley 41. The rotation mechanism 37 according to the present embodiment includes two driven pulleys 42. The transport belt 29 is hung and transported on a triangular ring including the driving pulley 41 and the driven pulleys 42. The transport belt 29 circulates outside the driving pulley 41 and the driven pulleys 42 by driving the belt motor 40. In detail, as the belt motor 40 is rotated forward, the rotation mechanism 37 rotates the transport belt 29 in a first rotation direction A1. As the belt motor 40 is rotated rearward, the rotation mechanism 37 rotates the transport belt 29 in a second rotation direction A2 that is opposite to the first rotation direction A1.

The clinging mechanism 38 includes the transport belt 29, a suction portion 45 having a suction chamber 44, and a fan 47 that sucks an inside of the suction chamber 44 via a duct 46. An outer surface of the transport belt 29 is a clinging surface 29*a* that cling the medium 12 to cling to the transport belt 29. The suction portion 45 is provided in a state of being in contact with an inner surface 29*b* that is an inner surface of the transport belt 29 such that a part of the suction chamber 44 is covered by the transport belt 29.

Figure 3:
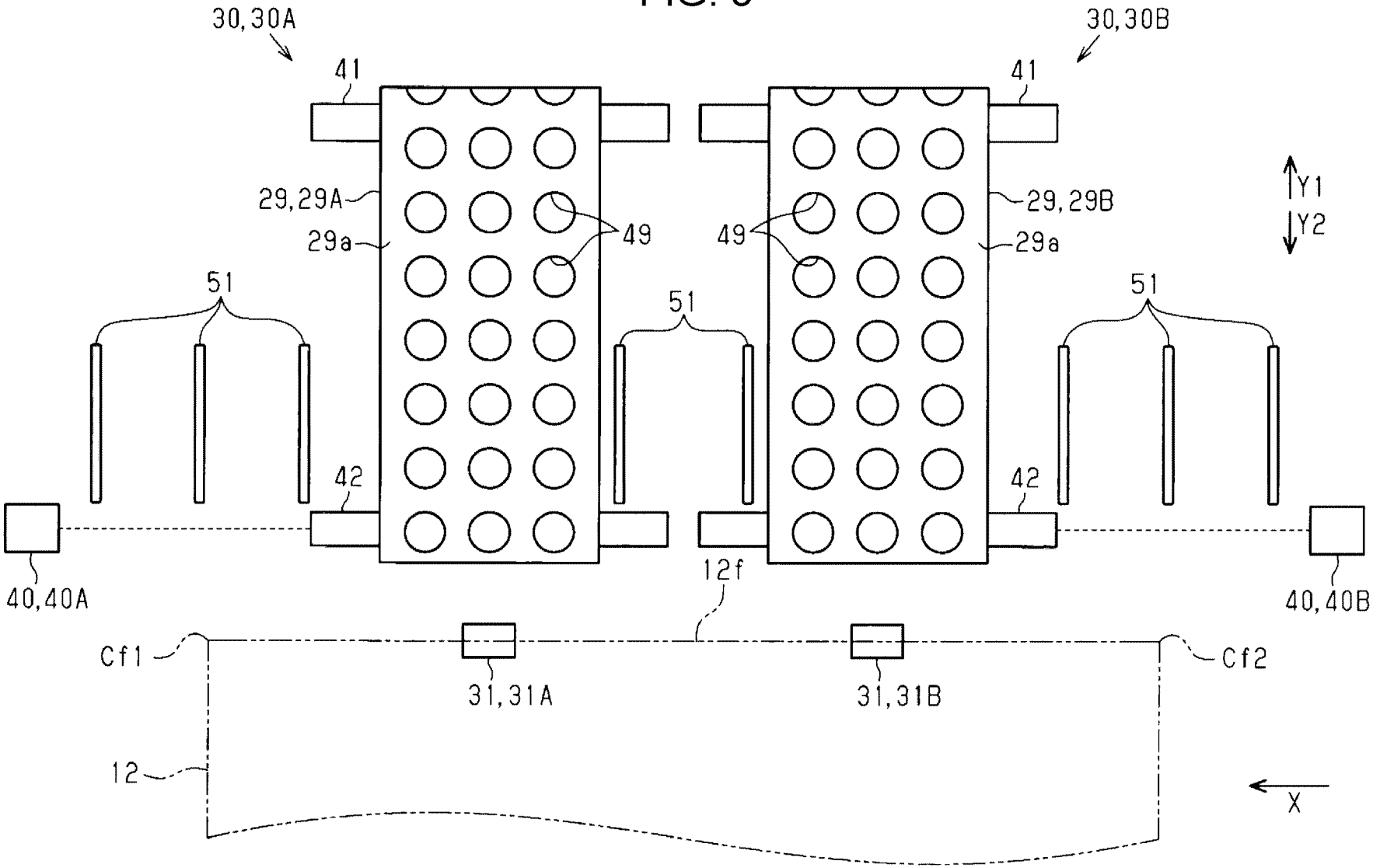
FIG. 3 is a schematic bottom view of a transport belt.

As illustrated in FIG. 3, the post-processing apparatus 14 includes the plurality of transport mechanisms 30 arranged at the same position in the first transport direction Y1 and at positions that are different from each other in the width direction X. The post-processing apparatus 14 includes the plurality of detection units 31 arranged at the same position in the first transport direction Y and at positions that are different from each other in the width direction X. The number of the transport mechanisms 30 and the number of the detection units 31 may be the same or may be different from each other. The post-processing apparatus 14 of the present embodiment includes a first transport mechanism 30A and a second transport mechanism 30B and a first detection unit 31A and a second detection unit 31B.

The first transport mechanism 30A includes a first transport belt 29A that rotates by driving a first belt motor 40A The second transport mechanism 30B includes a second transport belt 29B that rotates by driving a second belt motor 40B. In other words, the pair of transport belts 29 are provided at positions shifted in the width direction X, and the rotation mechanism 37 individually rotates the first transport belt 29A and the second transport belt 29B constituting the pair of transport belts 29. A large number of holes 49 passing through the transport belt 29 to open the clinging surface 29*a* and the inner surface 29*b* are formed in the transport belt 29.

The first detection unit 31A is disposed at the same position as the first transport belt 29A in the width direction X and at an upstream side position of the first transport belt 29A in the first transport direction Y1. The second detection unit 31B is disposed at the same position as the second transport belt 29B in the width direction X and at an upstream side position of the second transport belt 29B in the first transport direction Y1.

As illustrated in FIGS. 2 and 3, the clinging mechanism 38 causes an inside of the suction chamber 44 to have a negative pressure as the fan 47 is driven, and cling the medium 12 to the clinging surface 29*a* of the transport belt 29 through a hole 49 communicating with the suction chamber 44. That is, the clinging mechanism 38 cling the medium 12 to the transport belt 29 in a suction method of sucking air from the holes 49 formed in the transport belt 29.

As illustrated in FIG. 2, the transport mechanism 30 cling the medium 12 to the transport belt 29, rotates the transport belt 29 in this state, and transports the medium 12 in a region between the transport belt 29 and the intermediate stacker 32. In detail, the rotation mechanism 37 rotates the transport belt 29, to which the medium 12 is cling, in the first rotation direction A1, to transport the medium 12 in the first transport direction Y1. The rotation mechanism 37 rotates the transport belt 29, to which the medium 12 is cling, in the second rotation direction A2, to transport the medium 12 in the second transport direction Y2 that is opposite to the first transport direction Y1. After transporting the medium 12 in the first transport direction Y1, the rotation mechanism 37 transports the medium 12 in the second transport direction Y2 and stacks the medium 12 on the intermediate stacker 32.

Next, an embodiment of a separation flap 51 will be described.

As illustrated in FIG. 2, the post-processing apparatus 14 includes at least one separation flap 51 that detaches the medium 12 transported in the second transport direction Y2 from the transport belt 29, and an urging member 52, such as a torsion spring, that urges the separation flap 51. The post-processing apparatus 14 of the present embodiment includes eight separation flaps 51 arranged side by side at intervals in the width direction X. Each of the separation flaps 51 has a flap-upper surface 51*a* and a flap-lower surface 51*b*.

Among the plurality of separation flaps 51, the separation flap 51 interposed between the pair of transport belts 29 acts to separate the medium 12 from the transport belts 29 in common for all the medium 12 to be transported. Meanwhile, among the plurality of separation flaps 51, the separation flap 51 not interposed between the pair of transport belts 29 acts to cause at least a pair of separation flaps 51 to come into contact with a side end portion of the medium 12 so as to separate the medium 12 from the transport belts 29. Accordingly, even when the media 12 having different sizes are transported, the media 12 can be properly separated from the transport belts 29. Therefore, it is preferable that a position of the separation flap 51 not interposed between the pair of transport belts 29 be determined according to a plurality of standard sizes of the medium 12 considered to be transported.

The separation flap 51 swings about a flap shaft 53, and is provided such that a posture thereof can be changed. The separation flap 51 can be located at a first flap position indicated by a solid line of FIG. 2 and a second flap position indicated by a two-dot chain line of FIG. 2. The urging member 52 urges the separation flap 51 toward the first flap position. When the separation flap 51 is located at the first flap position, the flap-upper surface 51*a* and the flap-lower surface 51*b* intersect the clinging surface 29*a* of the transport belt 29 when viewed in the width direction X. When the separation flap 51 is located at the first flap position, an angle formed by the flap-upper surface 51*a* and the clinging surface 29*a* is an acute angle, and an angle formed by the flap-lower surface 51*b* and the clinging surface 29*a* is an obtuse angle.

Next, an electrical configuration of the medium processing apparatus 11 will be described.

Figure 4:
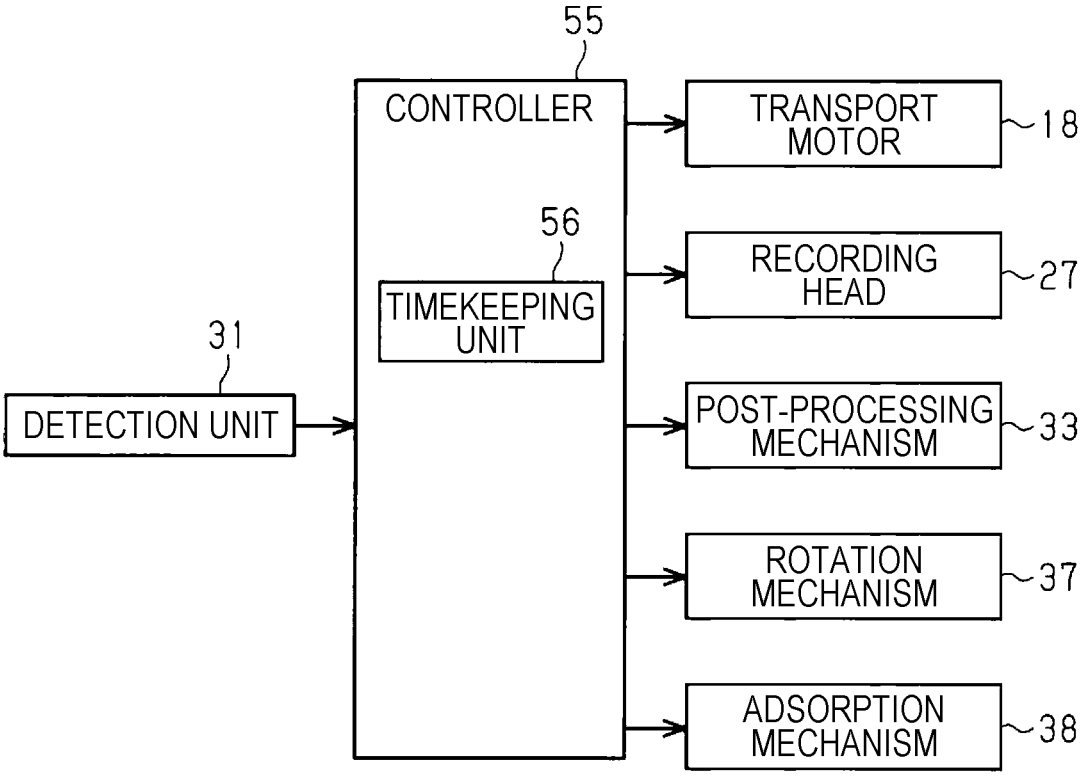
FIG. 4 is a block diagram illustrating an electric configuration of the medium processing apparatus.

As illustrated in FIG. 4, the medium processing apparatus 11 includes a controller 55 that comprehensively controls driving of mechanisms of the medium processing apparatus 11. The controller 55 includes a timekeeping unit 56 that measures a time. The controller 55 is connected to the detection unit 31 so as to receive a signal. The controller 55 transmits a signal to the transport motor 18, the recording head 27, the post-processing mechanism 33, the rotation mechanism 37, and the clinging mechanism 38, and controls operations of the mechanisms.

The controller 55 controls the rotation mechanism 37 according to a result of detection by the detection unit 31, and corrects a skew of the medium 12 in a state of being cling to the transport belt 29. In this point, the controller 55 functions as an example of a correction unit that corrects the skew of the medium 12.

Next, an operation of the medium processing apparatus 11 will be described.

As illustrated in FIG. 1, the medium 12 recorded by the recording head 27 is inclined, so-called obliquely moved, with respect to the first transport direction Y1 while being transported along the transport path 17. The skew is likely to be large when a region where the liquid adheres to the medium 12 is biased. For example, as compared with a case where the recording is performed such that the entire area of the medium 12 is filled, when the recording is performed such that a region on one side from a central side in the width direction X is filled, and the recording is not performed on a region on the other side from the central side, the medium 12 is likely to move obliquely. For example, the medium 12 is easy to move obliquely even when the recording is performed such that a region on the one side from the central side in the width direction X and on a downstream side from the central side in the first transport direction Y1 and a region on the other side from the central side in the width direction X and on an upstream side from the central side in the first transport direction Y1 are filled, and the recording is not performed on the other region.

As illustrated in FIGS. 2 and 3, the recorded medium 12 is transported in the first transport direction Y1 by the transport roller pair 19. When both the first detection unit 31A and the second detection unit 31B detect the front end 12*f*, the controller 55 executes one of a normal transport process and a correction transport process.

The normal transport process is a process when the medium 12 does not move obliquely or when the medium 12 slightly moves obliquely and the correction is not required. When the medium 12 does not move obliquely, the first detection unit 31A and the second detection unit 31B detect the front end 12*f* substantially at the same time. The controller 55 executes the normal transport process when a front time difference, which is a difference between a time when the first detection unit 31A detects the front end 12*f* and a time when the second detection unit 31B detects the front end 12*f*, is equal to or less than a threshold.

The correction transport process is a process when the correction is required because the medium 12 is greatly obliquely moves. As the skew of the medium 12 increases, the front end 12*f* of the medium 12 is inclined in the width direction X. Therefore, when the medium 12 moves obliquely, the front time difference becomes large. The controller 55 executes the correction transport process when the front time difference is larger than the threshold.

Next, a case where the normal transport process is executed will be described.

As illustrated in FIG. 2, the controller 55 drives the fan 47 and rotates the belt motor 40 in a forward direction to rotate the transport belt 29 in the first rotation direction A1.

Figure 5:
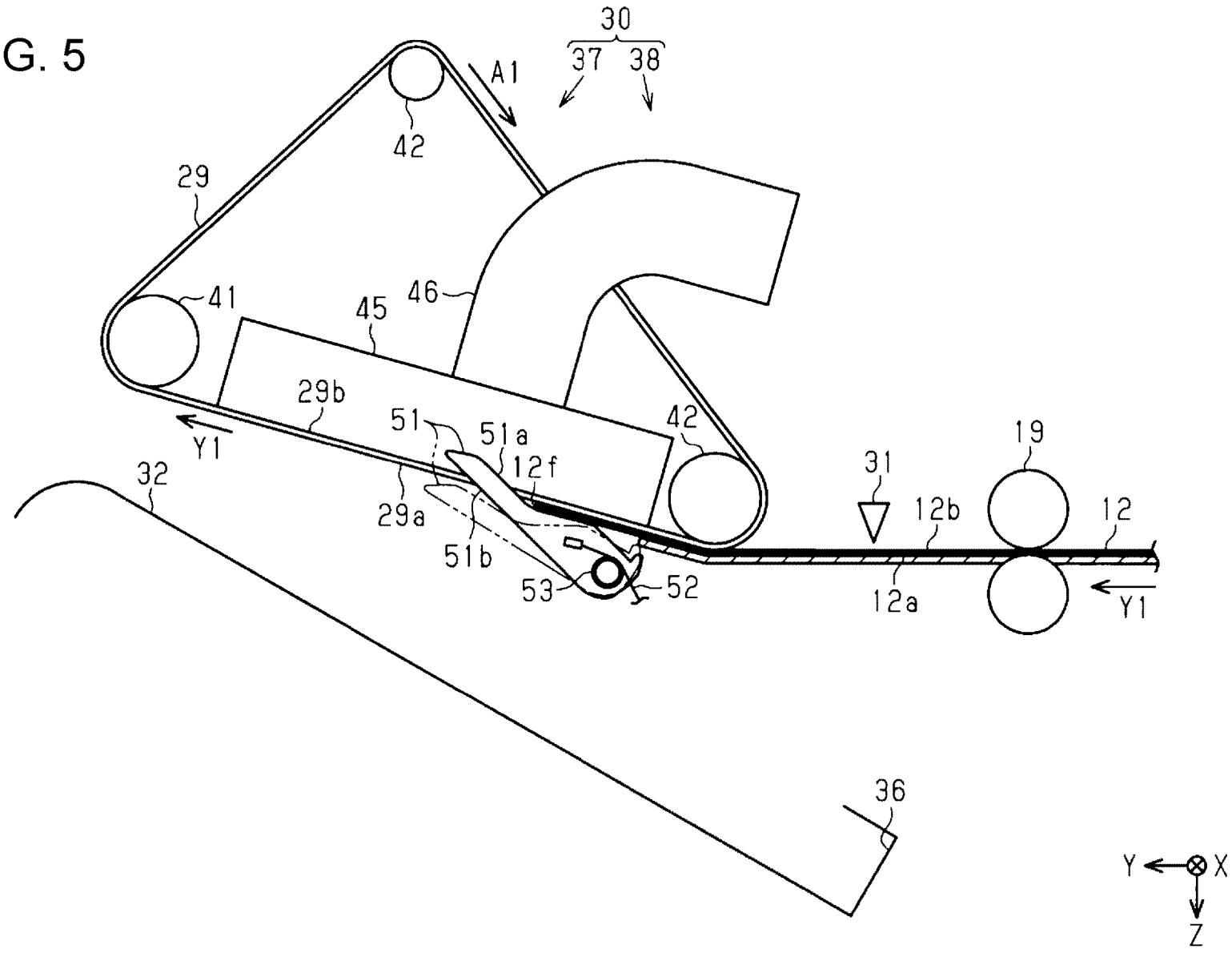
FIG. 5 is a schematic side view of the transport mechanism that causes a medium to cling to the transport belt.

As illustrated in FIG. 5, when the medium 12 is transported to the transport belt 29, the clinging mechanism 38 cling an upper surface 12*b* as an example of a second surface of the medium 12. The upper surface 12*b* of the medium 12 is a surface that is opposite to a lower surface 12*a* as an example of a first surface of the medium 12 on the intermediate stacker 32 side. While being cling to the transport belt 29, the medium 12 is transported in the first transport direction Y1 by the transport belt 29 that rotates in the first rotation direction A1.

When the medium 12 is transported to the separation flap 51, the front end 12*f* of the medium 12 comes into contact with the flap-upper surface 51*a* to push the separation flap 51. Accordingly, the separation flap 51 rotates against an urging force of the urging member 52, and moves to the second flap position indicated by a two-dot chain line of FIG. 5.

Figure 6:
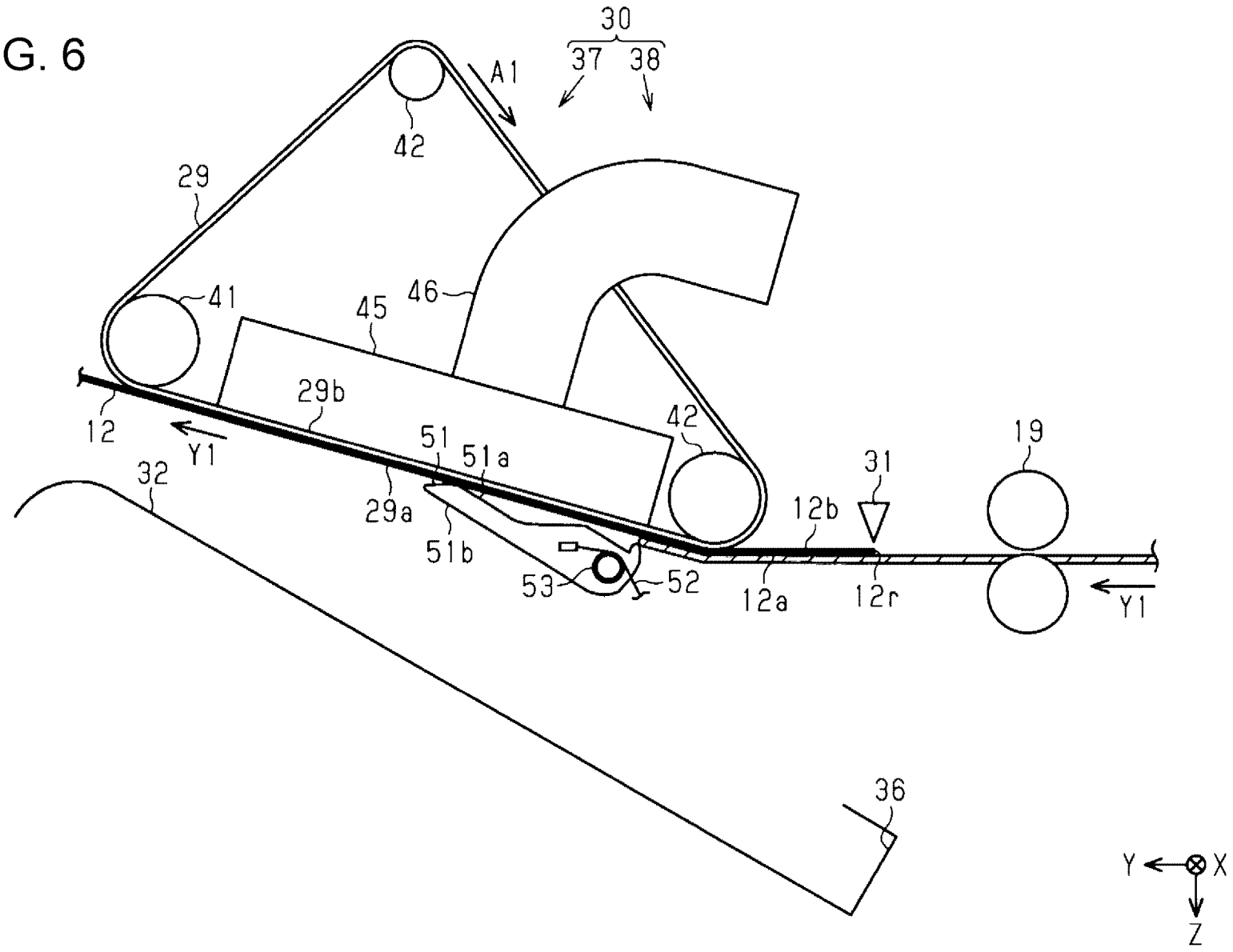
FIG. 6 is a schematic side view of the transport mechanism that transports the cling medium in a first transport direction.

As illustrated in FIG. 6, when the medium 12 transported in the first transport direction Y1 passes through the separation flap 51, at least a part of the flap-upper surface 51*a* comes into contact with the lower surface 12*a* of the medium 12. The medium 12 is pressed against the transport belt 29 by the separation flap 51 urged by the urging member 52 and is transported while being interposed between the separation flap 51 and the transport belt 29.

When the detection unit 31 detects the rear end 12*r*, the controller 55 drives the belt motor 40 in a reverse rotation after a predetermined time has elapsed. That is, when the rear end 12*r* is detected in a state which the belt motor 40 is driven in a forward rotation, the controller 55 continues the forward rotation driving of the belt motor 40 for a predetermined time to rotate the transport belt 29 in the first rotation direction A1. When a predetermined time elapses after the rear end 12*r* is detected, the controller 55 temporarily stops driving of the belt motor 40 and continuously drives the belt motor 40 in the reverse direction to rotate the transport belt 29 in the second rotation direction A2.

The predetermined time is a time required for the rear end 12*r* of the medium 12 to pass through the separation flap 51. The predetermined time is substantially equal to a quotient obtained by dividing a distance from the detection unit 31 to a tip end of the separation flap 51 along the transport path 17 by a speed at which the medium 12 is transported.

Figure 7:
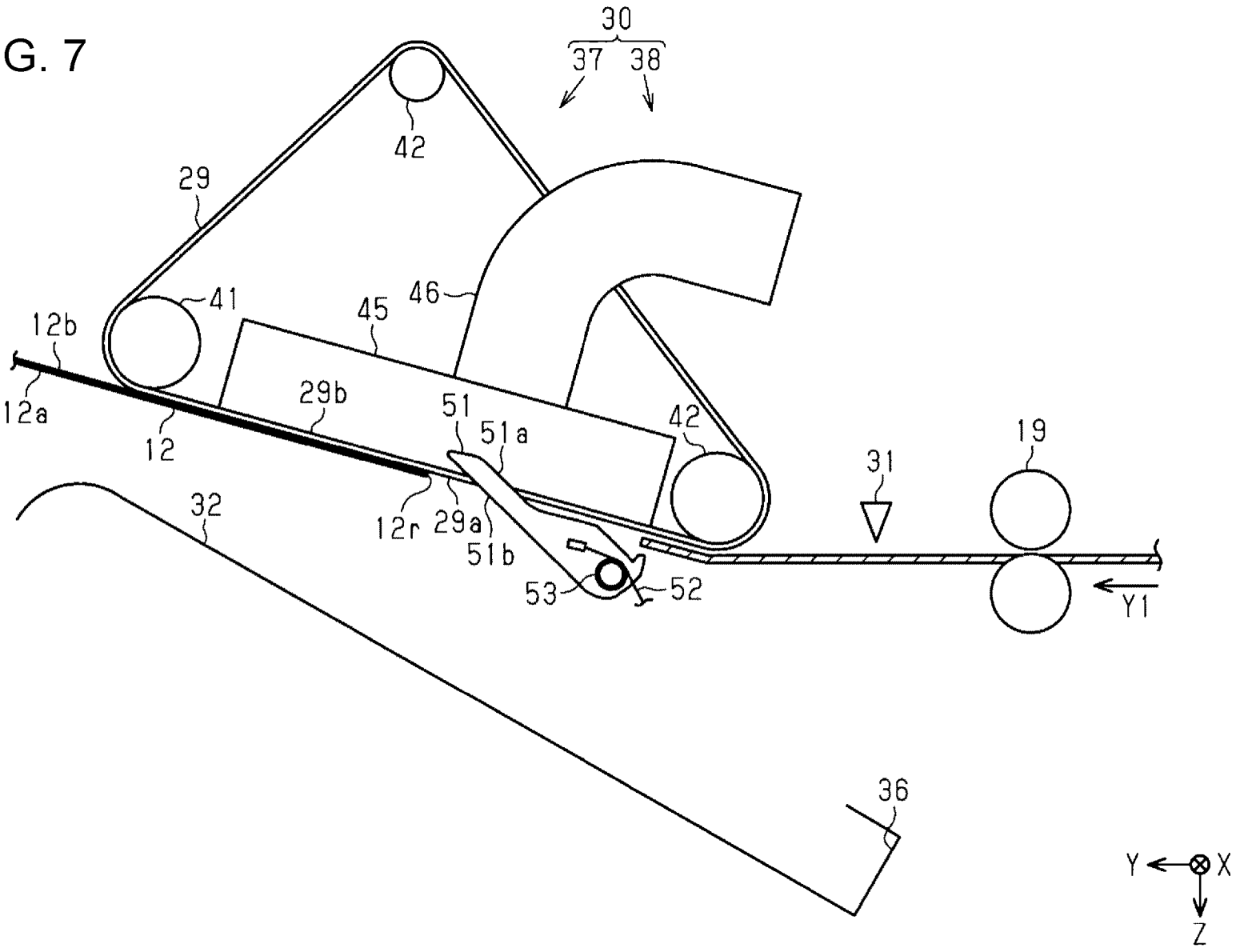
FIG. 7 is a schematic side view of the transport mechanism when a rotation direction of the transport belt is switched.

As illustrated in FIG. 7, when the rotation direction of the transport belt 29 is changed from the first rotation direction A1 to the second rotation direction A2 after the predetermined time elapses, the medium 12 is temporarily stopped in a state in which the rear end 12*r* is positioned on a downstream side of the separation flap 51 in the first transport direction Y1. When the medium 12 is separated from the separation flap 51, the separation flap 51 returns to the first flap position by an urging force of the urging member 52. That is, when the rotation direction of the transport belt 29 is switched from the first rotation direction A1 to the second rotation direction A2, the separation flap 51 is located in the first flap position.

Figure 8:
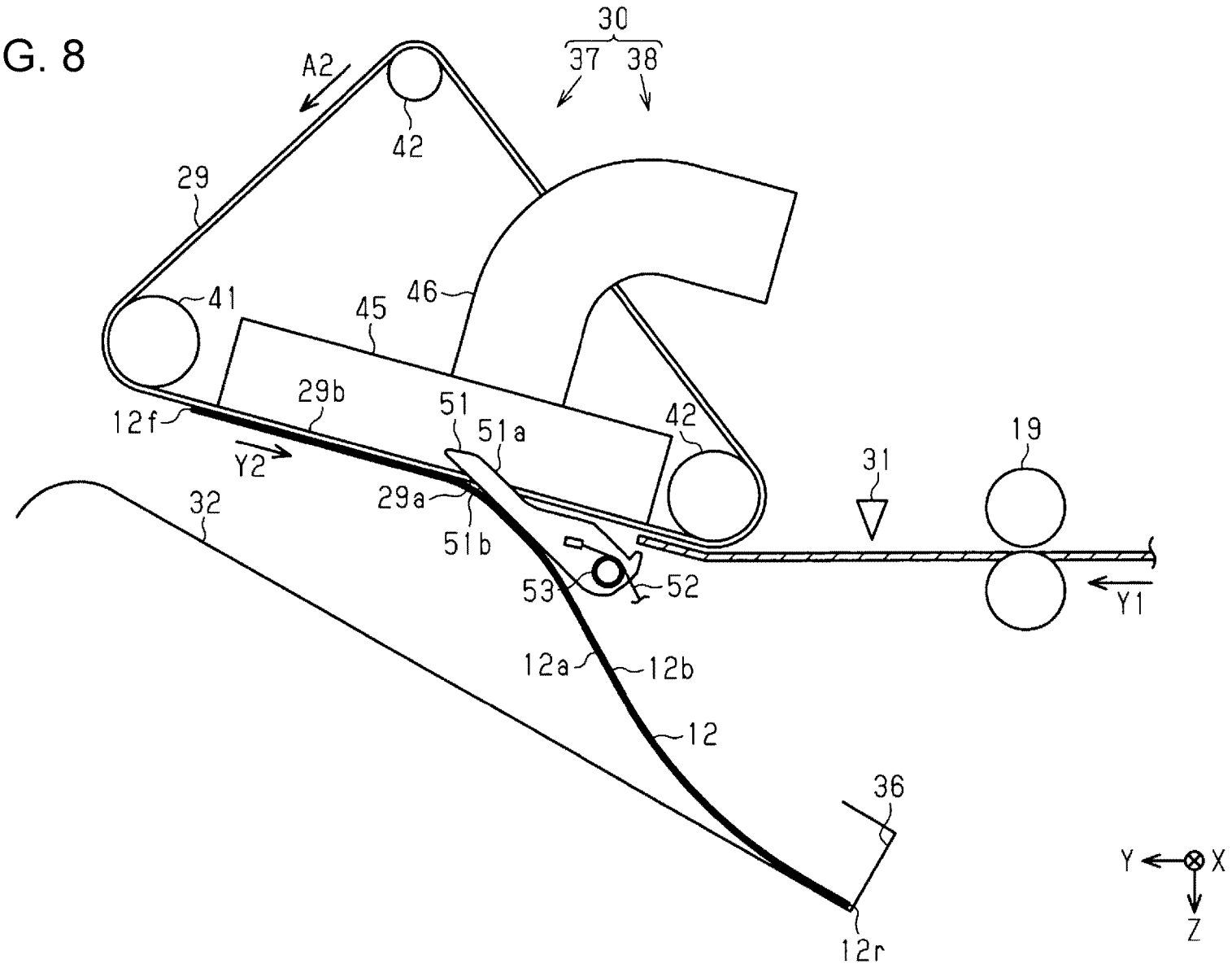
FIG. 8 is a schematic side view of the transport mechanism that transports the medium in a second transport direction.

As illustrated in FIG. 8, when the transport belt 29 rotates in the second rotation direction A2, the medium 12 is transported in the second transport direction Y2. At this time, the separation flap 51 is posed in the first flap position. At least a part of the flap-lower surface 51*b* comes into contact with the upper surface 12*b* of the medium 12 transported in the second transport direction Y2, and detaches the medium 12 from the clinging surface 29*a*. The rear end 12*r* of the medium 12 detached from the clinging surface 29*a* by the separation flap 51 comes into contact with the alignment unit 36 to be positioned, and the medium 12 is stacked on the intermediate stacker 32 positioned on a downstream side of the transport belt 29.

In this way, when the transport belt 29 rotates in the second rotation direction A2, and the medium 12 is transported in the second transport direction Y2, a part of the medium 12 is transported while being cling to the transport belt 29. Thus, a situation in which the medium 12 and the intermediate stacker 32 are separated from each other occurs. Accordingly, for example, a possibility that the lower surface 12*a* of the following medium 12 comes into contact with the upper surface 12*b* of the preceding medium 12 stacked on the intermediate stacker 32 in advance can be reduced.

In particular, in an ink jet printer using an aqueous ink, when a liquid such as an ink adheres to the medium 12, resistance when the media 12 slide together increases. Therefore, in stacking the following medium 12 on the intermediate stacker 32, there is a possibility that when a time during which the lower surface 12*a* of the following medium 12 is in contact with the upper surface 12*b* of the preceding medium 12 is long, the rear end 12*r* of the following medium 12 does not properly contact the alignment unit 36 and the following medium 12 cannot be properly stacked on the intermediate stacker 32, due to sliding resistance between the preceding medium 12 and the following medium 12.

However, as the medium 12 is cling to the transport belt 29, since a possibility that the lower surface 12*a* of the following medium 12 is in contact with the upper surface 12*b* of the preceding medium 12 stacked on the intermediate stacker 32 in advance can be reduced, the following medium 12 can be properly stacked on the intermediate stacker 32.

When a predetermined number of the media 12 (the number of the media 12 per copy when the medium 12 is post-processed) are stacked on the intermediate stacker 32, the post-processing mechanism 33 performs post-processing on the medium 12. The controller 55 drives a sending-out mechanism (not illustrated) to send out the medium 12 stacked on the intermediate stacker 32 from the intermediate stacker 32 in the first transport direction Y1. The medium 12 sent out from the intermediate stacker 32 is stacked on the discharge stacker 34.

Next, a case where the correction transport process is executed will be described.

Figure 9:
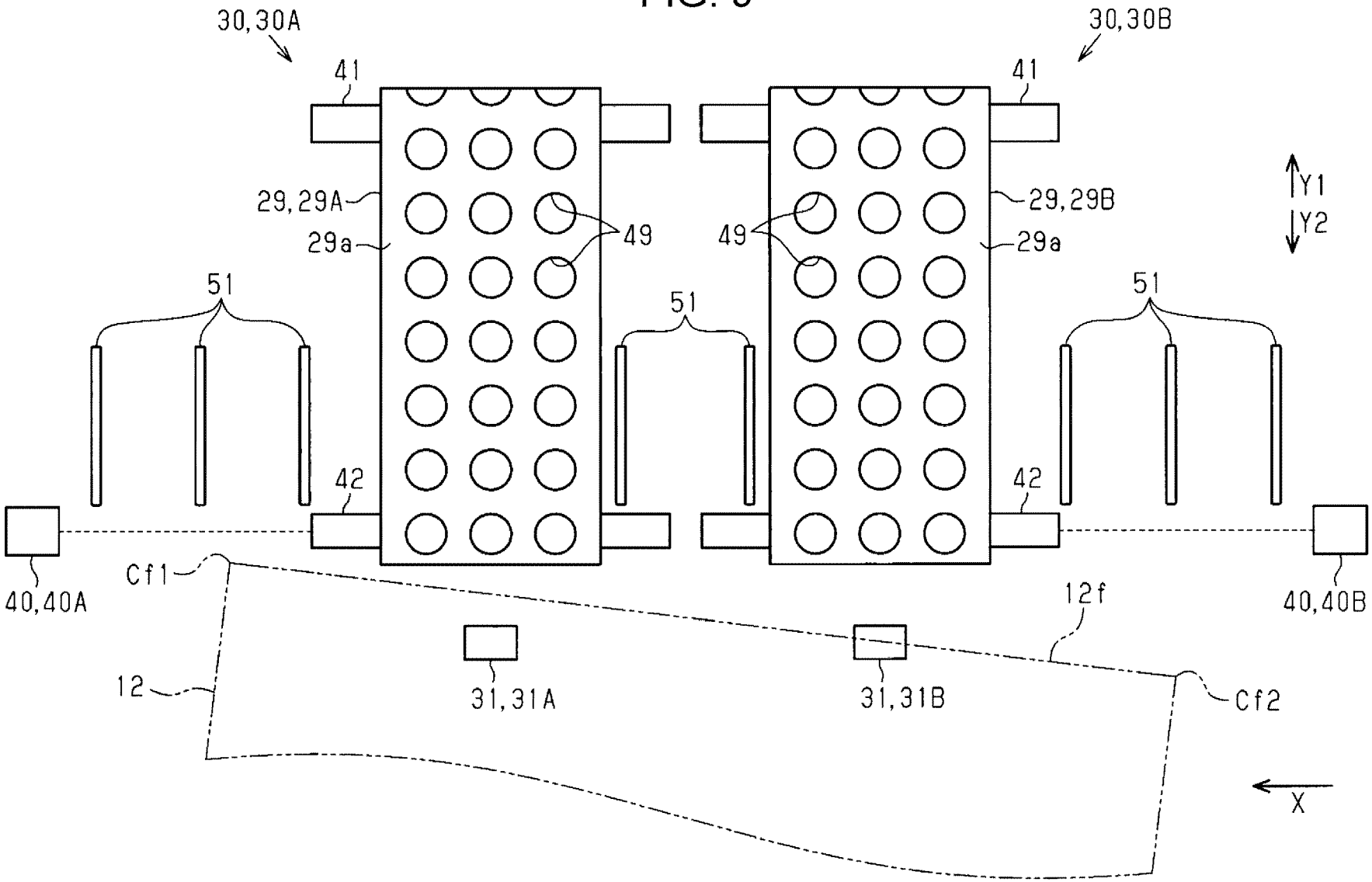
FIG. 9 is a schematic bottom view of the transport belt.

As illustrated in FIG. 9, in the medium 12 moving obliquely, positions of a first front angle Cf1 which is an angle of the front end 12*f* on a first transport belt 29A side and a second front angle Cf2 which is an angle on a second transport belt 29B side are shifted in the first transport direction Y1. A state in which the first front angle Cf1 is located on a downstream side of the second front angle Cf2 in the first transport direction Y1 is illustrated in FIG. 9. When the medium 12 moves obliquely in this manner, the first detection unit 31A detects the front end 12*f* before the second detection unit 31B.

The controller 55 drives the fan 47 when at least one detection unit 31 detects the front end 12*f*, and drives the belt motor 40 in the forward rotation when all the detection units 31 detect the front end 12*f*. That is, as illustrated in FIG. 9, the controller 55 drives the fan 47 when the first detection unit 31A detects the front end 12*f*, and drives the belt motor 40 in the forward rotation when the first detection unit 31A and the second detection unit 31B detect the front end 12*f*.

At this time, the controller 55 rotates the second transport belt 29B on the second detection unit 31B side that has subsequently detected the front end 12*f* at a faster speed than the first transport belt 29A on the first detection unit 31A side that has previously detected the front end 12*f*. For example, the controller 55 may set a rotation speed of the first transport belt 29A to be lower than a reference speed or may set a rotation speed of the second transport belt 29B to be higher than the reference speed.

It is preferable that a difference between a speed at which the first transport belt 29A rotates and a speed at which the second transport belt 29B rotates changes according to the front time difference. The controller 55 increases a difference between a rotation speed of the first transport belt 29A and a rotation speed of the second transport belt 29B as the front time difference increases. When the medium 12 is transported to the transport belt 29, the medium 12 is transported in a state of being clinging to the transport belt 29, and the skew is corrected such that the second front angle Cf2 catches up with the first front angle Cf1.

Figure 10:
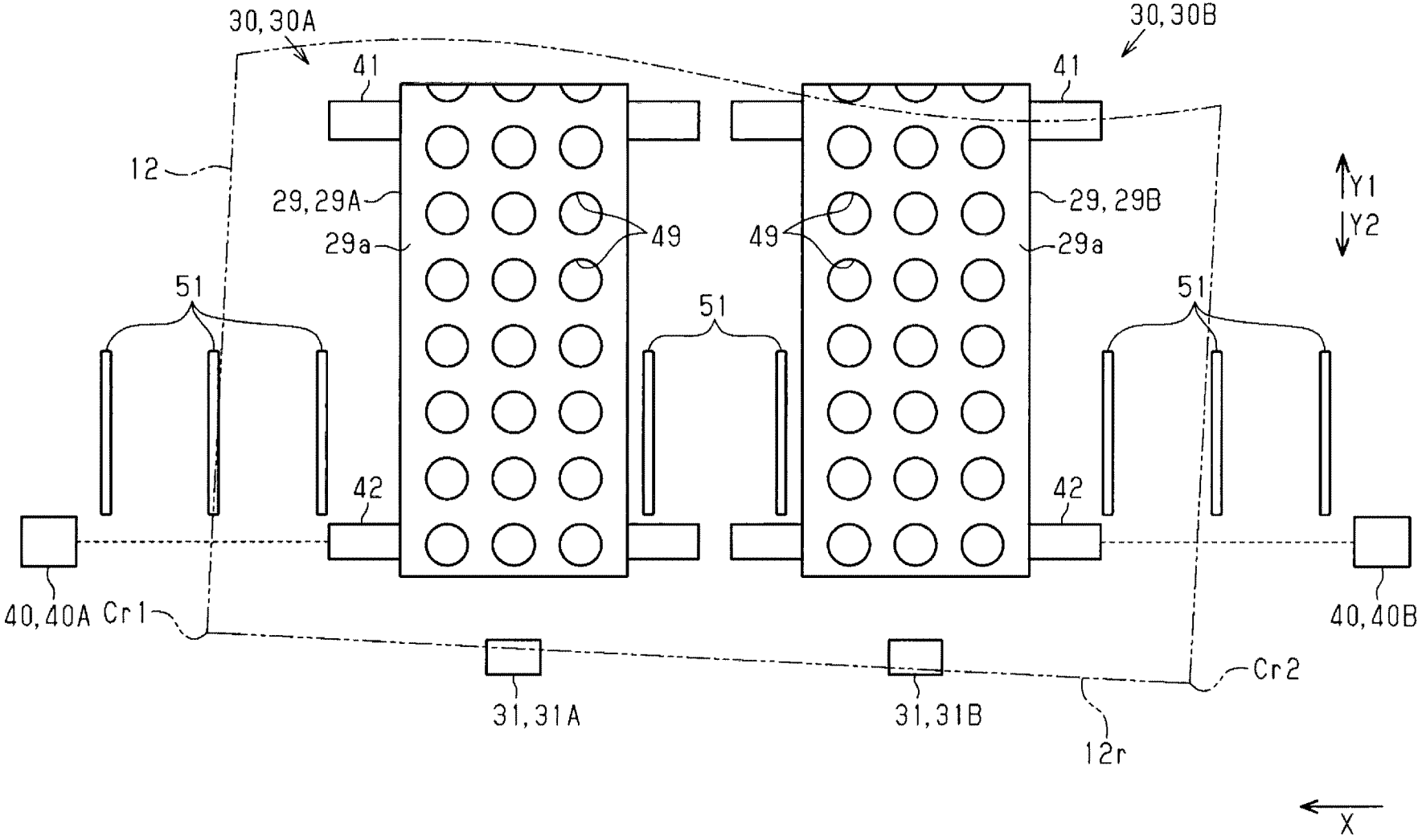
FIG. 10 is a schematic bottom view of the transport belt.

As illustrated in FIG. 10, for example, when the medium 12 largely obliquely moves or when the size of the medium 12 in the first transport direction Y1 is small, the skew may not be sufficiently corrected during the transportation in the first transport direction Y1. When the correction is sufficiently performed, among the rear end 12*r* of the medium 12, positions of a first rear angle Cr1 which is an angle on the first transport belt 29A side and a second rear angle Cr2 which is an angle on the second transport belt 29B side are shifted in the first transport direction Y1. A state in which the first rear angle Cr1 is located on a downstream side of the second rear angle Cr2 in the first transport direction Y1 is illustrated in FIG. 10. When the medium 12 moves obliquely in this manner, the first detection unit 31A detects the rear end 12*r* before the second detection unit 31B.

When a predetermined time elapses after the detection unit 31 including both the first detection unit 31A and the second detection unit 31B detects the rear end 12*r*, the controller 55 stops the first transport belt 29A and the second transport belt 29B while staggering a time. In a case illustrated in FIG. 10, the controller 55 firstly stops the first transport belt 29A on the first detection unit 31A side that has previously detected the rear end 12*r*, and then stops the second transport belt 29B on the second detection unit 31B side that has subsequently detected the rear end 12*r*. Accordingly, in a state in which the medium 12 is cling to the transport belt 29, the skew is corrected such that the first rear angle Cr1 and the second rear angle Cr2 are aligned in the first transport direction Y1.

It is preferable that a difference between a time when the first transport belt 29A is stopped and a time when the second transport belt 29B is stopped changes according to a rear time difference which is a difference between a time when the first detection unit 31A detects the rear end 12*r* and a time when the second detection unit 31B detects the rear end 12*r*. In detail, as the rear time difference increases, the controller 55 increases a time period from a time when the first transport belt 29A is stopped to a time when the second transport belt 29B is stopped.

As illustrated in FIG. 8, after driving of the belt motor 40 is temporarily stopped, the controller 55 continuously drives the belt motor 40 in the reverse rotation to rotate the transport belt 29 in the second rotation direction A2. When the transport belt 29 rotates in the second rotation direction A2, the medium 12 of which the skew is corrected is transported in the second transport direction Y2, is detached from the transport belt 29 by the separation flap 51, and is stacked on the intermediate stacker 32. When a predetermined number of the media 12 (the number of the media 12 per copy when the medium 12 is post-processed) are stacked on the intermediate stacker 32, the post-processing mechanism 33 performs post-processing on the medium 12. The controller 55 drives a sending-out mechanism (not illustrated) to send out the medium 12 stacked on the intermediate stacker 32 from the intermediate stacker 32 in the first transport direction Y1. The medium 12 sent out from the intermediate stacker 32 is stacked on the discharge stacker 34.

According to the above-described embodiment, the following effects can be obtained.

(1-1) Since the plurality of detection units 31 are arranged at intervals in the width direction X, the direction and the size in which the medium 12 moves obliquely can be easily detected. The controller 55 corrects the skew of the medium 12 in a state of being clinging to the transport belt 29 according to a result of the detection by the detection unit 31. Therefore, even when a region to be recorded in the medium 12 is biased, a reduction in alignment of the medium 12 stacked on the stacker can be suppressed.

(1-2) The pair of transport belts 29 are arranged to be shifted in the width direction X, and are individually rotatable by the rotation mechanism 37. Since the controller 55 controls the rotation mechanism 37 according to the result of the detection by the detection unit 31, the skew can be properly corrected according to the size of the skew of the medium 12.

(1-3) The clinging mechanism 38 cling, to the transport belt 29, the upper surface 12*b* that is opposite to the intermediate stacker 32 side in the medium 12. Therefore, the medium 12 cling to the transport belt 29 can be stacked to be dropped from above the intermediate stacker 32, and deviation due to friction between the media 12 can be suppressed.

(1-4) The clinging mechanism 38 cling the medium 12 to the transport belt 29 by a suction method. Therefore, for example, as compared to a case where the medium 12 is transported by a clinging belt, a possibility that the medium 12 is damaged can be reduced.

(1-5) Frictional resistance when the media 12 to which the liquid adheres by a recording process overlap with each other is larger than frictional resistance when the media 12 to which the liquid does not adhere overlap each other. Therefore, when the medium 12 after the recording process slides and is stacked on the previously recorded medium 12, the medium 12 may not be aligned. In this point, the transport mechanism 30 is located above the intermediate stacker 32 in the vertical direction Z, drops the medium 12 from above, and stacks the medium 12 on the intermediate stacker 32. Therefore, even when the recorded medium 12 having high frictional resistance is stacked on the intermediate stacker 32, the medium 12 can be aligned and stacked.

Second Embodiment

Next, a medium processing apparatus and a post-processing apparatus according to a second embodiment will be described with reference to the drawings. A configuration of a correction unit according to the second embodiment is different from that according to the first embodiment. Thus, since the other configuration is substantially the same as that according to the first embodiment, the same configuration is designated by the same reference numeral, and duplicated description thereof will be omitted.

Figure 11:
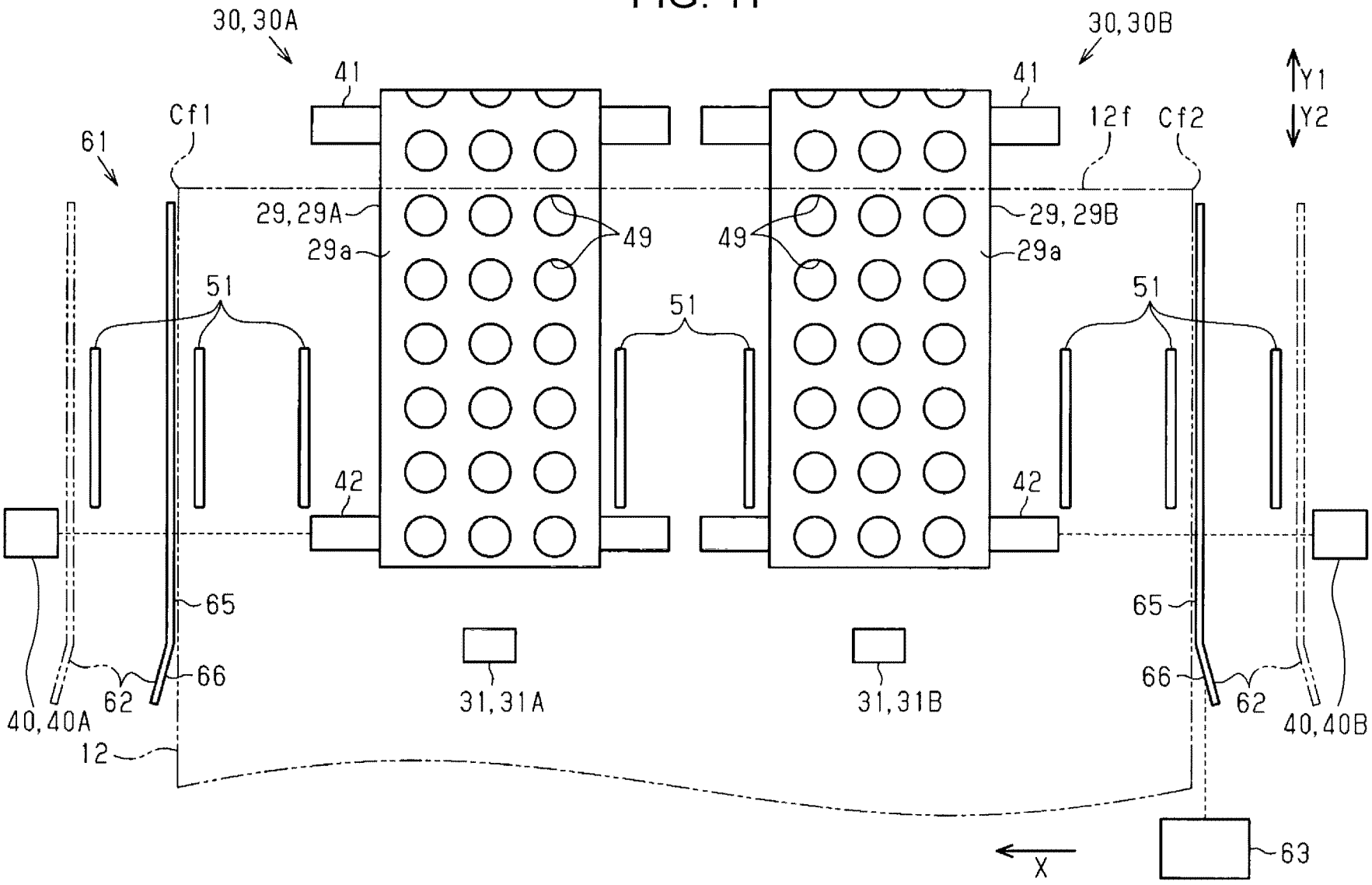
FIG. 11 is a schematic bottom view illustrating a correction unit of a post-processing apparatus according to a second embodiment.

As illustrated in FIG. 11, the post-processing apparatus 14 includes a correction unit 61 that corrects skew of the medium 12. The correction unit 61 includes a pair of guide units 62 provided at intervals in the width direction X and a movement mechanism 63 that moves the guide units 62 in the width direction X. The correction unit 61 corrects the skew of the medium 12 in a state of being clinging to the transport belt 29 according to the result of the detection by the detection unit 31, by relatively moving the pair of guide units 62 in the width direction X according to the result of the detection by the detection unit 31.

Each of the guide units 62 includes a correction wall 65 that comes into contact with an end of the medium 12 in the width direction X to correct an inclination of the medium 12 and a guide wall 66 that is provided on an upstream side of the correction wall 65 in the first transport direction Y1.

The correction wall 65 is provided to extend in the first transport direction Y1. It is preferable that the pair of correction walls 65 are parallel to each other. The pair of guide walls 66 are inclined such that an interval in the width direction X becomes narrower as the guide walls 66 approach the correction walls 65 in the first transport direction Y1. In the pair of guide units 62, an interval in the width direction X between the guide walls 66 located on an upstream side in the first transport direction Y1 is larger than an interval in the width direction X between the correction walls 65 located on a downstream side in the first transport direction Y1. In the first transport direction Y1, the size of the correction walls 65 is larger than the size of the guide walls 66.

The movement mechanism 63 moves the pair of guide units 62 to a guide position indicated by a solid line of FIG. 11 and a retraction position indicated by a two-dot chain line of FIG. 11, which is a position where the guide units 62 are separated from each other by a distance that is larger than a distance of the guide position. The guide position is a position where the medium 12 is guided in the width direction X, and changes according to the size of the medium 12. In the pair of guide units 62 located in the guide position, an interval between the correction walls 65 in the width direction X is substantially equal to the width of the medium 12. The retraction position is a position retracted in the width direction X from the medium 12. In the pair of guide units 62 located in the retraction position, the interval between the correction walls 65 in the width direction X is wider than the width of the medium 12.

Next, an operation of the medium processing apparatus 11 will be described.

Similar to the first embodiment, the controller 55 executes any one of the normal transport process and the correction transport process based on a result of the detection by the first detection unit 31A and the second detection unit 31B.

In the normal transport process, in a state in which the pair of guide units 62 are located in the retraction position, the controller 55 drives the belt motor 40 in the forward rotation to rotate the transport belt 29 in the first rotation direction A1, and then drives the belt motor 40 in the reverse rotation to rotate the transport belt 29 in the second rotation direction A2. That is, similar to the first embodiment, the controller 55 transports the medium 12 in the first transport direction Y1 to cause the medium 12 to pass through the separation flap 51, and then transports the medium 12 in the second transport direction Y2 to stack the medium 12 detached from the transport belt 29 by the separation flap 51 on the intermediate stacker 32.

As illustrated in FIG. 11, in the correction transport process, the controller 55 drives the movement mechanism 63 to position the pair of guide units 62 in the guide position indicated by the solid line of FIG. 11, and drives the belt motor 40 in the forward rotation. That is, when the rotation mechanism 37 rotates the transport belt 29 in the first rotation direction A1, the correction unit 61 positions the pair of guide units 62 in the guide position. The medium 12 transported in the first transport direction Y1 is guided between the correction walls 65 by the guide walls 66 in a state of being cling to the transport belt 29, and ends of the medium 12 in the width direction X follow the correction walls 65, so that the skew is corrected.

When the first detection unit 31A and the second detection unit 31B detect the rear end 12*r*, the controller 55 drives the belt motor 40 in the reverse rotation after a predetermined time has elapsed, and drives the movement mechanism 63 to position the pair of guide units 62 in the retraction position indicated by the two-dot chain line of FIG. 11. That is, when the rotation mechanism 37 rotates the transport belt 29 in the second rotation direction A2, the correction unit 61 positions the pair of guide units 62 in the retraction position. When the transport belt 29 rotates in the second rotation direction A2, the medium 12 of which the skew is corrected is transported in the second transport direction Y2, is detached from the transport belt 29 by the separation flap 51, and is stacked on the intermediate stacker 32.

According to the above-described second embodiment, in addition to the effects of the above-described first embodiment, the following effects can be obtained.

(2-1) The correction unit 61 relatively moves the pair of guide units 62 in the width direction X according to the result of the detection by the detection unit 31. Therefore, the width of the guide units 62 can change in accordance with the width and the skew of the medium 12, and a possibility that the guide units 62 come into contact with the medium 12 more than necessary, and thus the medium 12 is damaged can be reduced.

(2-2) When the medium 12 is transported in the first transport direction Y1, the correction unit 61 positions the pair of guide units 62 in the guide position to correct the skew of the medium 12. The interval between the pair of guide units 62 in the width direction X is larger on an upstream side than on a downstream side in the first transport direction Y1. Therefore, the medium 12 transported in the first transport direction Y1 can be easily introduced between the pair of guide units 62, and the skew of the medium 12 introduced between the pair of guide units 62 can be corrected.

Third Embodiment

Next, a medium processing apparatus and a post-processing apparatus according to a third embodiment will be described with reference to the drawings. In the third embodiment, a configuration of the correction unit is different from that according to the first embodiment and the second embodiment. Thus, since the other configuration is substantially the same as that according to the first embodiment and the second embodiment, the same configuration is designated by the same reference numeral, and duplicated description thereof will be omitted.

Figure 12:
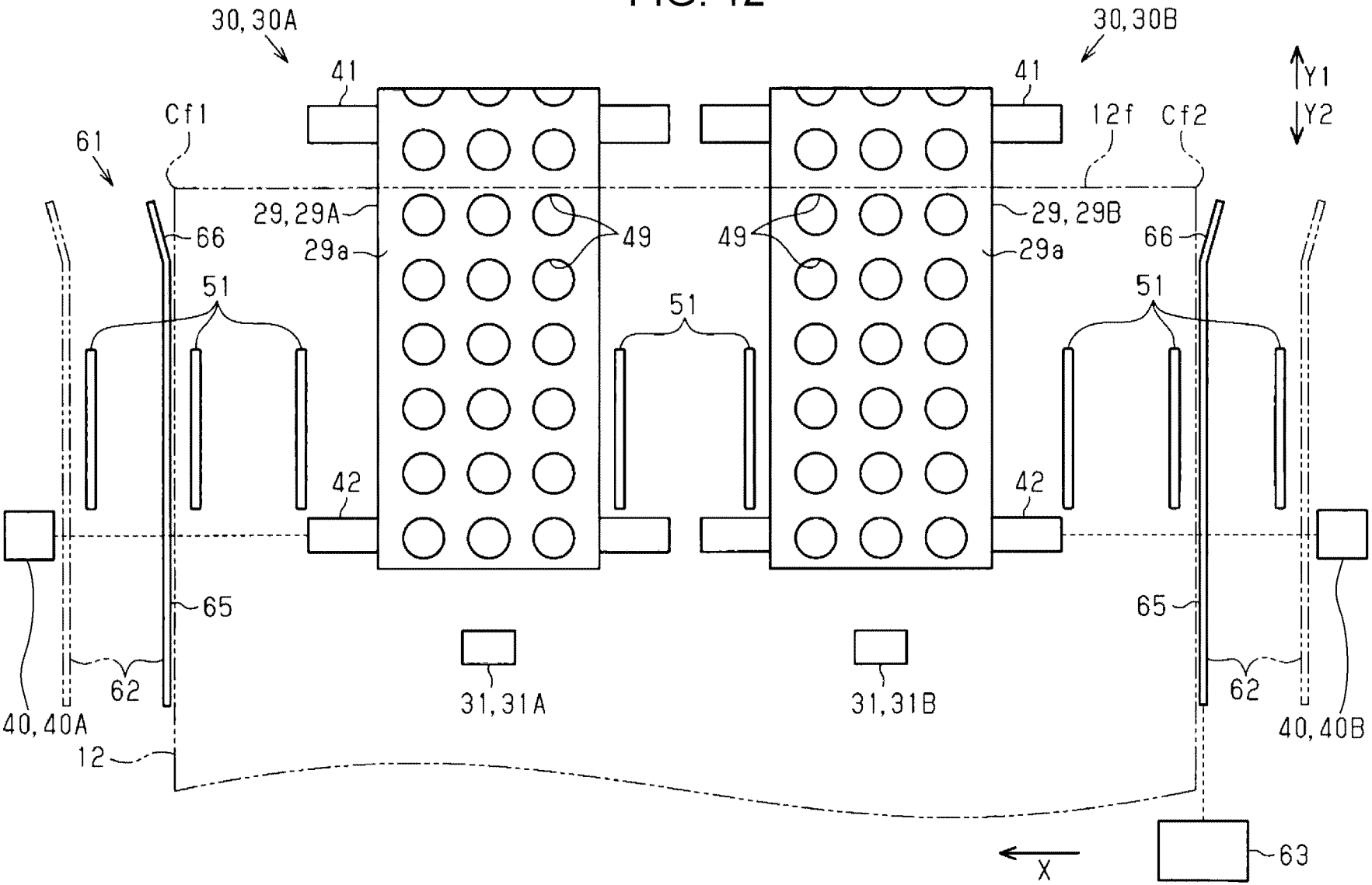
FIG. 12 is a schematic bottom view illustrating a correction unit of a post-processing apparatus according to a third embodiment.

As illustrated in FIG. 12, each of the guide units 62 includes a correction wall 65 and a guide wall 66 provided on an upstream side of the correction wall 65 in the second transport direction Y2. In the pair of guide units 62, the interval therebetween in the width direction X on the upstream side in the second transport direction Y2 is larger than the interval therebetween in the width direction X on a downstream side in the second transport direction Y2.

Next, an operation of the medium processing apparatus 11 will be described.

Similar to the first embodiment, the controller 55 executes any one of the normal transport process and the correction transport process based on a result of the detection by the first detection unit 31A and the second detection unit 31B.

In the normal transport process, in a state in which the pair of guide units 62 are located in the retraction position, the controller 55 drives the belt motor 40 in the forward rotation to rotate the transport belt 29 in the first rotation direction A1, and then drives the belt motor 40 in the reverse rotation to rotate the transport belt 29 in the second rotation direction A2. That is, similar to the first embodiment, the controller 55 transports the medium 12 in the first transport direction Y1 to cause the medium 12 to pass through the separation flap 51, and then transports the medium 12 in the second transport direction Y2 to stack the medium 12 detached from the transport belt 29 by the separation flap 51 on the intermediate stacker 32.

As illustrated in FIG. 12, in the correction transport process, the controller 55 drives the movement mechanism 63 to position the pair of guide units 62 in the retraction position indicated by the two-dot chain line of FIG. 12, and drives the belt motor 40 in the forward rotation. That is, when the rotation mechanism 37 rotates the transport belt 29 in the first rotation direction A1, the correction unit 61 positions the pair of guide units 62 in the retraction position.

When the first detection unit 31A and the second detection unit 31B detect the rear end 12*r*, the controller 55 drives the belt motor 40 in the reverse rotation after a predetermined time has elapsed, and drives the movement mechanism 63 to position the pair of guide units 62 in the guide position indicated by the solid line of FIG. 12. That is, when the rotation mechanism 37 rotates the transport belt 29 in the second rotation direction A2, the correction unit 61 positions the pair of guide units 62 in the guide position. The medium 12 transported in the second transport direction Y2 is guided between the correction walls 65 by the guide walls 66 in a state of being cling to the transport belt 29, and ends of the medium 12 in the width direction X follow the correction walls 65, so that the skew is corrected. The medium 12 of which the skew is corrected is transported in the second transport direction Y2, is detached from the transport belt 29 by the separation flap 51, and is stacked on the intermediate stacker 32.

According to the above-described third embodiment, in addition to the effects of the above-described first embodiment and the above-described second embodiment, the following effects can be obtained.

(3-1) When the medium 12 is transported in the second transport direction Y2, the correction unit 61 positions the pair of guide units 62 in the guide position to correct the skew of the medium 12. The interval between the pair of guide units 62 in the width direction X is larger on an upstream side than on a downstream side in the second transport direction Y2. Therefore, the medium 12 transported in the second transport direction Y2 can be easily introduced between the pair of guide units 62, and the skew of the medium 12 introduced between the pair of guide units 62 can be corrected.

The above-described embodiment may be changed to modifications described below. The above-described embodiment and the following modifications may be combined with each other in a predetermined manner. Configurations included in the following modifications may be combined with each other in a predetermined manner.

The post-processing apparatus 14 may be configured so as not to include the urging member 52. For example, the separation flap 51 may have a weight at a position that is opposite to a side of the flap shaft 53, which is in contact with the medium 12, and the separation flap 51 positioned in the second flap position may return to the first flap position by a weight thereof. The post-processing apparatus 14 may have, for example, a solenoid that moves the separation flap 51 and a driving source that moves the separation flap 51, such as a motor that rotates the flap shaft 53.

The post-processing apparatus 14 may include a roller that interposes the medium 12 between the post-processing apparatus 14 and the transport belt 29 and is driven to rotate as the medium 12 is transported. When the roller is a toothed roller having unevennesses formed on a peripheral surface thereof, a concern that the liquid adhering to the lower surface 12*a* of the duplex printed medium 12 is moved to the roller can be reduced.

The post-processing apparatus 14 may include a presser that presses the medium 12 stacked on the intermediate stacker 32. The presser is configured with a plate-like elastic member rotatably provided or a weight displaceably provided. The presser presses the medium 12 stacked on the intermediate stacker 32 when the transport belt 29 rotates in the first rotation direction A1, and moves to a position separated from the medium 12 when the transport belt 29 rotates in the second rotation direction A2.

The post-processing mechanism 33 may perform, as post-processing, a predetermined process such as a punch process of opening a hole in the medium 12, a shift process of moving and discharging the medium 12 in sheet units, a cutting process of cutting the medium 12, a signature process of folding the medium 12, a bookbinding process of bookbinding the medium 12, and a collating process.

In the first embodiment, the post-processing apparatus 14 may include the pair of guide units 62 and the movement mechanism 63.

The movement mechanism 63 may fix one guide unit 62 and move the other guide unit 62 to the one guide unit 62 among the pair of guide units 62.

In a state in which the width between the pair of guide units 62 is adjusted to the width of the medium 12, the movement mechanism 63 may move the pair of guide units 62 adjusted to the skew of the medium 12, in the width direction X. For example, when the obliquely moved medium 12 is located to be shifted from a central portion in the width direction X in the transport path 17, the central portion of the pair of guide units 62 in the width direction X may be additionally shifted to the medium 12.

In the first embodiment and the third embodiment, the detection unit 31 may be provided at the same position as the transport belt 29. For example, when the transport belt 29 rotating in the first rotation direction A1 is temporarily stopped to rotate in the second rotation direction A2, the detection unit 31 may be provided at a position where the rear end 12*r* of the medium 12 can be detected. The controller 55 and the correction unit 61 may correct the skew when the medium 12 is transported in the second transport direction Y2, based on the result of the detection by the detection unit 31.

When the transport belt 29 rotating in the first rotation direction A1 is temporarily stopped to rotate in the second rotation direction A2, the controller 55 and the correction unit 61 may correct the skew while the transportation of the medium 12 is stopped.

The correction unit 61 may position the pair of guide units 62 in the guide position before the medium 12 is transported to the guide units 62 or may position the pair of guide units 62 in the guide position in a state in which the medium 12 is located between the pair of guide units 62.

In the second embodiment and the third embodiment, the post-processing apparatus 14 may include one transport mechanism 30. The transport mechanism 30 may have a configuration in which the plurality of transport belts 29 are wound around one driving pulley 41 driven by one belt motor 40.

In the first embodiment, the controller 55 may correct the skew based on one of the forward time difference and the rear time difference.

In the first embodiment, the controller 55 may correct the skew of the medium 12 when the medium 12 is transported in the second transport direction Y2, and may correct the skew of the medium 12 when the medium 12 is transported in the first transport direction Y1. The controller 55 may correct the skew of the medium 12 both when the medium 12 is transported in the first transport direction Y1 and when the medium 12 is transported in the second transport direction Y2. When the skew of the medium 12 transported in the second transport direction Y2 is corrected, if the front time difference or the rear time difference is equal to or more than the threshold, the controller 55 may rotate the transport belt 29 as follows. For example, the controller 55 may rotate the transport belt 29 on the detection unit 31 side that has subsequently detected the rear end 12*r* later than the transport belt 29 on the detection unit 31 side that has previously detected the rear end 12*r*. For example, the controller 55 may set a rotation speed of the transport belt 29 on the detection unit 31 side that has previously detected the rear end 12*r* to be larger than a rotation speed of the transport belt 29 on the detection unit 31 side that has subsequently detected the rear end 12*r*.

The clinging mechanism 38 may causes the medium 12 to cling to the transport belt 29 by an electrostatic clinging unit in which the medium 12 and the transport belt 29 are charged.

The clinging mechanism 38 may causes the lower surface 12*a* of the medium 12 to cling to the transport belt 29. The transport mechanism 30 may transport the medium 12 on which the lower surface 12*a* is cling, may stack the medium 12 on the intermediate stacker 32.

The medium processing apparatus 11 may be an apparatus integrally having a function of the intermediate device 15, a function of the post-processing apparatus 14, and a function of the printing device 13.

The medium processing apparatus 11 may be an apparatus including a device integrally having a function of the intermediate device 15 and a function of the post-processing apparatus 14 and the printing device 13.

The medium processing apparatus 11 may be configured not to include the intermediate device 15 and the post-processing apparatus 14, and the transport mechanism 30 and a stacker on which the medium 12 transported by the transport mechanism 30 is stacked may be provided in the printing device 13. The medium processing apparatus 11 may be configured not to include the post-processing mechanism 33. The medium processing apparatus 11 may be stacked on the stacker of the printing device 13 such that the medium 12 recorded by the recording head 27 is transported in the first transport direction Y1 and the second transport direction Y2 by the transport mechanism 30 and the rear end 12*r* of the medium 12 is aligned.

The liquid, which is attached to the medium 12, can be selected in a predetermined manner as long as the liquid can be printed on the medium 12. The material is in a liquid phase state, and includes a fluid-state body such as liquid having high viscosity or low viscosity, sol, gel water, other inorganic solvents, an organic solvent, a solution, liquid resin, and liquid metal (metal melt). Further, the state of the material includes a solution obtained by dissolving, dispersing, and mixing, in a solvent, particles of a functional material made of a solid such as a pigment or metal particles, in addition to the liquid. Representative examples of liquids include an ink. The ink includes various kinds of liquid compositions such as general water-based ink and oil-based ink, gel ink, hot melt ink and the like.

The medium processing apparatus 11 is an apparatus that attaches a liquid such as an ink to the medium 12, and prints an image such as a letter, a picture, and a photograph, and may be a serial printer, a lateral printer, a page printer, and the like. Further, the printing device may be an offset printing device, a textile printing device, or the like.

What is claimed is:

1. A medium transporting apparatus comprising:

a clinging portion that causes a medium to cling to a transport belt that has a loop shape;

a rotation portion that transports the medium by rotating the transport belt;

a plurality of detection units that detect a transport direction end of the medium;

a correction unit that corrects a skew of the medium; and a stacker on which the medium transported by the transport belt is stacked, wherein the plurality of detection units are arranged at positions that are on an upstream side of the transport belt in the transport direction and that are different from each other in a width direction that is perpendicular to the transport direction, wherein the correction unit corrects, according to a result of the detection by the detection units, the skew of the medium in a state of being clung to the transport belt, and wherein the clinging portion causes a second surface of the medium, which is on an opposite side of the medium from a stacker-side first surface, to cling to the transport belt.

2. The medium transporting apparatus according to claim 1, further comprising another transport belt arranged in a direction orthogonal to the transporting direction of the medium with respect to the transport belt, wherein the rotation portion individually rotates the transport belt and the other transport belt, and wherein the correction unit controls the rotation portion according to the result of the detection by the detection units.

3. The medium transporting apparatus according to claim 1, wherein the correction unit has a pair of guide units provided at an interval in the width direction, and relatively moves the pair of guide units in the width direction according to the result of the detection by the detection units.

4. The medium transporting apparatus according to claim 3, wherein the rotation portion transports the medium in a first transport direction by rotating the transport belt in a first rotation direction, and transports the medium in a second transport direction by rotating the transport belt in a second rotation direction that is opposite to the first rotation direction, wherein an interval between the pair of guide units in the width direction on an upstream side in the first transport direction is larger than an interval between the pair of guide units in the width direction on a downstream side in the first transport direction, and the pair of guide units are located at a guide position where the guide units guide the medium in the width direction and a retraction position where the guide units are retracted from the medium in the width direction, and wherein the correction unit positions the pair of guide units at the guide position when the rotation portion rotates the transport belt in the first rotation direction, and positions the pair of guide units at the retraction position when the rotation portion rotates the transport belt in the second rotation direction.

5. The medium transporting apparatus according to claim 3, wherein the rotation portion transports the medium in a first transport direction by rotating the transport belt in a first rotation direction, and transports the medium in a second transport direction by rotating the transport belt in a second rotation direction that is opposite to the first rotation direction, wherein an interval between the pair of guide units in the width direction on an upstream side in the second transport direction is larger than an interval between the pair of guide units in the width direction on a downstream side in the second transport direction, and the pair of guide units are located at a guide position where the guide units guide the medium in the width direction and at a retraction position where the guide units are retracted from the medium in the width direction, and wherein the correction unit positions the pair of guide units at the retraction position when the rotation portion rotates the transport belt in the first rotation direction, and positions the pair of guide units at the guide position when the rotation portion rotates the transport belt in the second rotation direction.

6. The medium transporting apparatus according to claim 1, wherein the clinging portion clings the medium to the transport belt by a suction method of sucking air from a hole formed in the transport belt or an electrostatic clinging unit of charging the medium and the transport belt.

7. A post-processing apparatus comprising:

a transport belt that has a loop shape;

a clinging portion that causes a medium to cling to the transport belt;

a rotation portion that transports the medium by rotating the transport belt;

a plurality of detection units that detect an end of the medium in a transport direction;

a correction unit that corrects a skew of the medium;

an intermediate stacker on which the medium transported by the transport belt is stacked;

a post-processing mechanism that post-processes the medium stacked on the intermediate stacker; and a discharge stacker on which the medium sent out from the intermediate stacker is stacked, wherein the plurality of detection units are arranged at positions that are on an upstream side of the transport belt in the transport direction and that are different from each other in a width direction that is perpendicular to the transport direction, and wherein the correction unit corrects the skew of the medium in a state of being clung to the transport belt according to a result of the detection by the detection units.

8. A medium transporting apparatus comprising:

a clinging portion that causes a medium to cling to a transport belt that has a loop shape;

a rotation portion that transports the medium by rotating the transport belt;

a plurality of detection units that detect a transport direction end of the medium;

a correction unit that corrects a skew of the medium; and a stacker on which the medium transported by the transport belt is stacked, wherein the plurality of detection units are arranged at positions that are on an upstream side of the transport belt in the transport direction and that are different from each other in a width direction that is perpendicular to the transport direction, wherein the correction unit corrects, according to a result of the detection by the detection units, the skew of the medium in a state of being clung to the transport belt, and wherein the correction unit has a pair of guide units provided at an interval in the width direction, and relatively moves the pair of guide units in the width direction according to the result of the detection by the detection units.

9. The medium transporting apparatus according to claim 8, wherein the rotation portion transports the medium in a first transport direction by rotating the transport belt in a first rotation direction, and transports the medium in a second transport direction by rotating the transport belt in a second rotation direction that is opposite to the first rotation direction, wherein an interval between the pair of guide units in the width direction on an upstream side in the first transport direction is larger than an interval between the pair of guide units in the width direction on a downstream side in the first transport direction, and the pair of guide units are located at a guide position where the guide units guide the medium in the width direction and a retraction position where the guide units are retracted from the medium in the width direction, and wherein the correction unit positions the pair of guide units at the guide position when the rotation portion rotates the transport belt in the first rotation direction, and positions the pair of guide units at the retraction position when the rotation portion rotates the transport belt in the second rotation direction.

10. The medium transporting apparatus according to claim 8, wherein the rotation portion transports the medium in a first transport direction by rotating the transport belt in a first rotation direction, and transports the medium in a second transport direction by rotating the transport belt in a second rotation direction that is opposite to the first rotation direction, wherein an interval between the pair of guide units in the width direction on an upstream side in the second transport direction is larger than an interval between the pair of guide units in the width direction on a downstream side in the second transport direction, and the pair of guide units are located at a guide position where the guide units guide the medium in the width direction and at a retraction position where the guide units are retracted from the medium in the width direction, and wherein the correction unit positions the pair of guide units at the retraction position when the rotation portion rotates the transport belt in the first rotation direction, and positions the pair of guide units at the guide position when the rotation portion rotates the transport belt in the second rotation direction.

11. The medium transporting apparatus according to claim 8, wherein the clinging portion clings the medium to the transport belt by a suction method of sucking air from a hole formed in the transport belt or an electrostatic clinging unit of charging the medium and the transport belt.

* * * * *